United States Patent [19]

Diaz-Cano

[11] 4,224,749

[45] Sep. 30, 1980

[54] HEELS FOR FOOTWEAR

[76] Inventor: Juan A. Diaz-Cano, 8 Willow St., Romford, Essex, England

[21] Appl. No.: 972,936

[22] Filed: Dec. 26, 1978

[51] Int. Cl.[3] ..... A43B 21/26

[52] U.S. Cl. ..... 36/35 R; 36/34 R; D2/323

[58] Field of Search ..... 36/35 R, 35 A, 34 R, 36/3 R, 59 R; D2/323

[56] References Cited

U.S. PATENT DOCUMENTS

| | | | |
|---|---|---|---|
| D. 61,789 | 1/1923 | Pietzuch | 36/35 R |
| 1,371,398 | 3/1921 | Schirmer | 36/35 R |
| 2,235,256 | 3/1941 | Elliott | 36/34 R |
| 2,998,661 | 9/1961 | Israel | 36/35 R |
| 3,169,327 | 2/1965 | Furuoka | 36/34 R |

FOREIGN PATENT DOCUMENTS

| | | | |
|---|---|---|---|
| 981601 | 1/1951 | France | 36/35 R |
| 1152421 | 9/1957 | France | 36/34 R |
| 391510 | 9/1965 | Switzerland | 36/35 R |
| 2764 | of 1903 | United Kingdom | 36/35 R |
| 10773 | of 1915 | United Kingdom | 36/35 R |
| 100451 | 5/1916 | United Kingdom | 36/35 R |

*Primary Examiner*—James Kee Chi

*Attorney, Agent, or Firm*—Brisebois & Kruger

[57] ABSTRACT

A heel for footwear includes a resilient, compressible generally wedge-shaped insert which is secured between a ground-engaging part and an upper part of the heel and absorbs shock. The insert tapers in depth away from the back of the heel while the rear end of the ground-engaging part of the heel slopes upwardly towards the back of the heel to reduce wear at the back of the heel.

5 Claims, 3 Drawing Figures

HEELS FOR FOOTWEAR

BACKGROUND OF THE INVENTION

The present invention relates to heels for footwear.

With many articles of footwear when the back of the heel hits the ground as the wearer is walking along, the impact is sufficiently hard to jar the wearers own heel and possibly also the leg and consequently cause discomfort and unnecessary fatigue.

Various solutions have been proposed to this problem and have achieved a greater or lesser degree of acceptance.

The most common solution is to make the ground-engaging part of the heel of rubber. However the rubber must necessarily be fairly hard so that the heel does not wear down too quickly in use and consequently, the rubber is not particularly effective in absorbing the shock.

A further construction provides a heel incorporating a resilient insert, made for example of soft rubber, but although such a construction is more effective in absorbing shocks, it is found in practice such heels often have relatively poor wearing properties and therefore only a short life.

In another construction a metal spring element is incorporated in the heel, so that the spring is compressed by a wearer when walking as the heel hits the ground and thereby absorbs some of the shock.

It is an object of the invention to provide an improved resilient heel structure having a high efficiency and a long life.

A further object of the present invention is to provide a heel for footwear which not only effectively absorbs shocks resulting from the impact of the back of the heel hitting the ground, but which is also constructed so as to result in a reduction in wear at the back of the heel, and at the same time provide improved walking characteristics.

SUMMARY OF THE INVENTION

The invention consists in a heel for footwear, including a resilient, compressible generally wedge-shaped insert which is secured between a ground-engaging part and an upper part of the heel and which tapers in depth away from the back of the heel and wherein the rear end of the ground-engaging part of the heel slopes upwardly towards the back of the heel. The insert may have a rear end face which is inclined upwardly towards the front of the heel.

Advantageously, the ground-engaging part of the heel may be provided with a region, e.g. a groove, which extends from side-to-side across the heel and which facilitates flexing of the ground-engaging part. This region preferably forms a boundary between the upwardly sloping rear end and the remainder of the ground-engaging part.

Preferably, the outline in plan of the ground-engaging part at the back of the heel is in the form of a flat or shallow curve so that the rear of the ground-engaging part provides a relatively wide treading base.

The ground-engaging part and upper part of the heel may be made of a high density natural or synthetic rubber or of a polyvinyl chloride or similar material. These two parts may be formed integrally as a one-piece moulding. The wedge-shaped insert may be made of a low density resilient foam material, such as a foam natural or synthetic rubber or a blown P.V.C.

The heel may conveniently be made by a two-part injection moulding process in which the high density material is first injected into a mould to form a one-piece moulding comprising the upper and ground-engaging parts of the heel and subsequently the low density resilient foam material is injected into the space between these parts to form the wedge-shaped insert which becomes bonded to the adjacent surfaces of the parts.

BRIEF DESCRIPTION OF THE DRAWINGS

In order that the invention may be more readily understood, reference will now be made to the accompanying drawings, in which.

DETAILED DESCRIPTION OF THE INVENTION

Figure 1:
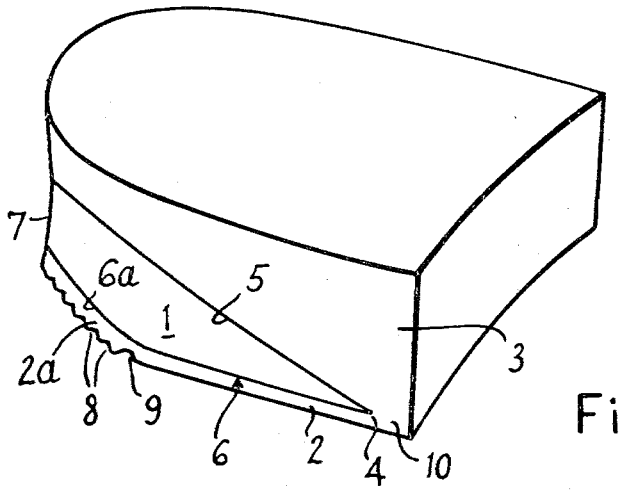
FIG. 1 is a perspective view of one embodiment of heel according to the invention.
Figure 2:
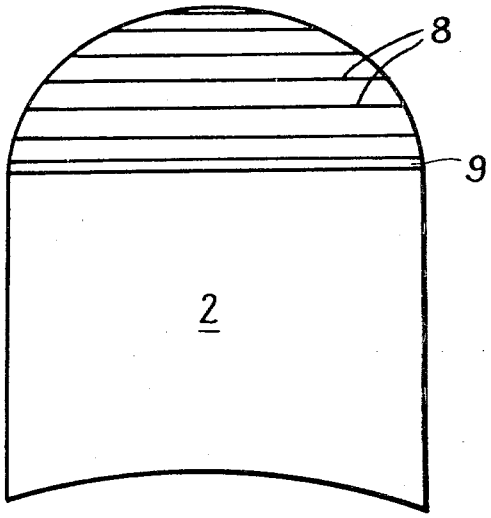
FIG. 2 is an underneath plan view of the heel.

Referring to FIGS. 1 and 2 a heel for footwear includes a resilient compressible generally wedge-shaped insert 1 which is secured between a ground-engaging part 2 and an upper part 3 of the heel. The insert 1 and the parts 2 and 3 may be made of the materials and in the manner described above.

The insert 1 extends across the whole width of the heel and from the back of the heel to a region 4 situated close behind the front of the heel.

The upper surface 5 of the insert 1 slopes downwardly over its whole length from the back of the heel, whilst the rear lower surface portion 6*a* of lower surface 6 of the insert 1 slopes downwardly from the back of the heel and then merges with the remainder of the lower surface 6 which extends generally parallel to the ground-engaging part 2.

The rear end portion 2*a* of the ground-engaging part 2 slopes upwardly and away from the front of the heel.

The rear end face 7 of the insert is inclined downwardly and rearwardly away from the front end of the heel.

A tread pattern 8 is provided on the rear end portion 2*a* and a groove 9 extends from side-to-side across the bottom of the heel between the portion 2*a* and the remainder of the ground-engaging part 2. The groove 9 facilitates flexing of the rear end portion 2*a*.

As can be seen from FIG. 2, the outline in plan of the back of the ground-engaging part 2 of the heel is a flat or shallow curve so as to provide a relatively wide treading base for the heel.

When fitted to a shoe (see FIG. 3), the construction of the heel will allow the ground-engaging part 2 of the heel rearwardly of region 4 to flex towards and compress the insert 1 when a wearer of the shoe brings his heel into contact with the ground whilst walking. The ground-engaging part can hinge or flex both at the region 4 and also at the groove 9. The sloping rear end portion 2*a* is provided so as to reduce wear at or towards the back of the heel and also assists a wearer to adopt and maintain a good walking posture; whilst the inclination of the rear end face 7 aids the resilient action of the insert.

During walking, the insert acts as a shock absorber and also provides resilience in the heel which imparts an upward and forward motion to the foot. Whilst the wearer is standing, the portion 10 of the heel in front of the forward end of the insert serves to support the weight of the wearer.

Figure 3:
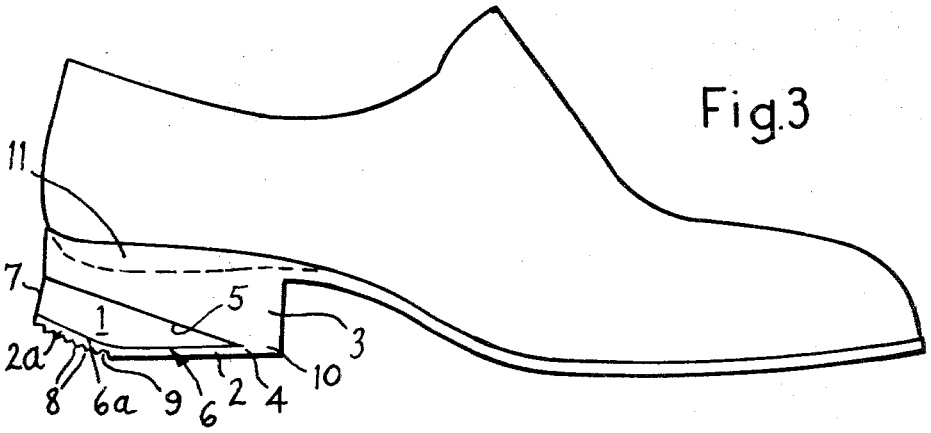
FIG. 3 is a side view of a shoe incorporating the heel.

As shown in FIG. 3, the heel is formed integral with the sole of the shoe. Moreover, the upper surface of the upper part 3 of the heel may be lowered or recessed (as shown in broken lines) to accommodate a sock or cushioning 11 to increase the comfort for the heel of the wearer.

In a modification (not shown) the rear end face 7 of the insert is not inclined upwardly towards the front of the heel but may, for example, be substantially coplanar with the rear end face of the upper part 3 of the heel.

What is claimed is:

1. A heel for footwear comprising:

a ground-engaging part;

an upper part;

a resilient, compressible generally wedge-shaped insert which is secured between said ground-engaging part and said upper part and which tapers in depth away from the back of the heel;

said ground-engaging part having a rear end which slopes upwardly towards the back of the heel;

said resilient, compressible generally wedge-shaped insert having a rear end face which is inclined downwardly and rearwardly away from the front of the heel, a flexing region extending from side-to-side across said heel between said upwardly sloping rear end and the remainder of said ground-engaging part, and a recess in said upper part to accommodate cushioning for the heel of a wearer's foot.

2. A heel for footwear comprising:

a ground-engaging part;

an upper part;

a resilient, compressible generally wedge-shaped insert which is secured between said ground-engaging part and said upper part and which tapers in depth away from the back of the heel;

said ground-engaging part having a rear end which slopes upwardly towards the back of the heel;

said resilient, compressible generally wedge-shaped insert having a rear end face which is inclined downwardly and rearwardly away from the front of the heel, and a region which extends from side-to-side across said heel to facilitate flexing between said upwardly sloping rear end and the remainder of the ground-engaging part of said heel.

3. A heel as claimed in claim 2, wherein said region to facilitate flexing is a groove between said upwardly sloping rear end and the remainder of the ground-engaging part of said heel.

4. In an article of footwear, a heel comprising:

a ground-engaging part;

an upper part;

a resilient, compressible generally wedge-shaped insert which is secured between said ground-engaging part and said upper part and which tapers in depth away from the back of the heel;

said ground-engaging part having a rear end which slopes upwardly towards the back of the heel;

said resilient, compressible generally wedge-shaped insert having a rear end face which is inclined downwardly and rearwardly away from the front of the heel, and a flexing region extending from side-to-side across said heel between said upwardly sloping rear end and the remainder of said ground-engaging part.

5. In an article of footwear, a heel comprising:

a ground-engaging part;

an upper part;

a resilient, compressible generally wedge-shaped insert which is secured between said ground-engaging part and said upper part and which tapers in depth away from the back of the heel;

said ground-engaging part having a rear end which slopes upwardly towards the back of the heel;

said resilient, compressible generally wedge-shaped insert having a rear end face which is inclined downwardly and rearwardly away from the front of the heel, and a recess in said upper part to accommodate cushioning for the heel of a wearer's foot.

* * * * *